US006318852B1

(12) United States Patent
White

(10) Patent No.: US 6,318,852 B1
(45) Date of Patent: Nov. 20, 2001

(54) COLOR GAMUT EXTENSION OF AN INK COMPOSITION

(75) Inventor: Stephen David White, San Jose, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/223,615

(22) Filed: Dec. 30, 1998

(51) Int. Cl.[7] ..... G01D 11/00
(52) U.S. Cl. ..... 347/100; 347/96
(58) Field of Search ..... 347/46, 100, 96, 347/95

(56) References Cited

U.S. PATENT DOCUMENTS

| | | | | |
|---|---|---|---|---|
| 4,166,277 | | 8/1979 | Cielo et al. . | |
| 4,308,547 | | 12/1981 | Lovelady et al. . | |
| 4,383,265 | | 5/1983 | Kohashi . | |
| 4,544,931 | | 10/1985 | Watanabe et al. . | |
| 4,593,295 | | 6/1986 | Matsufuji et al. . | |
| 4,620,196 | | 10/1986 | Hertz et al. . | |
| 4,630,076 | * | 12/1986 | Yoshimura | 347/43 |
| 4,697,195 | | 9/1987 | Quate et al. . | |
| 4,719,476 | | 1/1988 | Elrod et al. . | |
| 4,719,480 | | 1/1988 | Elrod et al. . | |
| 4,746,935 | | 5/1988 | Allen . | |
| 4,748,461 | | 5/1988 | Elrod . | |
| 4,751,529 | | 6/1988 | Elrod et al. . | |
| 4,751,530 | | 6/1988 | Elrod et al. . | |
| 4,751,534 | | 6/1988 | Elrod et al. . | |
| 4,851,860 | | 7/1989 | Mutoh . | |
| 4,959,674 | | 9/1990 | Khri-Yakab et al. . | |
| 5,028,937 | | 7/1991 | Khuri-Yakub et al. . | |
| 5,041,849 | | 8/1991 | Quate et al. . | |
| 5,087,931 | | 2/1992 | Rawson . | |
| 5,111,220 | | 5/1992 | Hadimioglu et al. . | |
| 5,121,141 | | 6/1992 | Hadimioglu et al. . | |
| 5,122,818 | | 6/1992 | Elrod et al. . | |
| 5,142,307 | | 8/1992 | Elrod et al. . | |
| 5,216,451 | | 6/1993 | Rawson et al. . | |
| 5,281,261 | | 1/1994 | Lin . | |
| 5,625,397 | | 4/1997 | Allred et al. . | |
| 5,643,357 | * | 7/1997 | Breton et al. | 347/100 |
| 5,667,168 | | 9/1997 | Sacripante et al. . | |
| 5,688,312 | | 11/1997 | Sacripante et al. . | |
| 5,693,128 | | 12/1997 | Sacripante et al. . | |
| 5,700,316 | | 12/1997 | Pontes et al. . | |
| 5,716,217 | * | 2/1998 | Imagawa et al. | 434/408 |

* cited by examiner

*Primary Examiner*—John Barlow
*Assistant Examiner*—Manish S Shah
(74) *Attorney, Agent, or Firm*—Fay, Sharpe, Fagan, Minnich & McKee, LLP

(57) ABSTRACT

The present invention describes a method of extending the color gamut of a colored printing ink through the use of a color gamut extending agent or ink. The present method is suitable for use in any printing method such as ink jet printing, and, in particular, acoustic ink printing (AIP).

19 Claims, 3 Drawing Sheets

COLOR GAMUT EXTENSION OF AN INK COMPOSITION

FIELD OF THE INVENTION

The present invention is directed to a method of extending the color gamut of a colored printing ink in a printing process. The method described below uses an additional ink material to lighten or darken the chroma of an underlying colored ink thereby extending the color gamut of the underlying ink.

BACKGROUND OF THE INVENTION

Liquid ink printing may take a number of forms. In ink jet printing, exemplified by U.S. Pat. No. 4,544,931 (Watanabe et al.), a liquid droplet is ejected from a single scanning nozzle and in U.S. Pat. No. 4,593,295 (Matsufuji et al.), liquid droplets are ejected from multi-nozzle, multi-color heads arranged for scanning. In electroosmotic ink recording, exemplified by U.S. Pat. No. 4,383,265 (Kohashi), ink droplets are made to fly from the tip of a needle shaped recording electrode. Similarly, in electrostatic ink ejection, exemplified by U.S. Pat. No. 4,166,277 (Cielo et al.), ink is retained in holes of an ink reservoir and is attracted out of the holes by the selective application of a voltage between the ink and selected electrodes. In acoustic ink printing, exemplified by U.S. Pat. No. 4,308,547 (Lovelady et al.), a liquid drop emitter focusses acoustic energy to eject a liquid ink.

In most applications, an ejected droplet must be deposited upon a receiving medium in a predetermined, possibly controlled, fashion. For example, when color printing it is very important that an ejected droplet accurately mark the recording medium in a predetermined fashion so as to produce the desired visual effect. The need for accurate positioning of ejected droplets on a receiving medium makes it desirable to eject droplets of the different colors in the same pass of the printhead across the recording medium, otherwise slight variations between the relative positions of the droplet ejectors and the receiving medium, or changes in either of their characteristics or the characteristics of the path between them, can cause registration problems (misaligned droplets).

Acoustic ink printing provides a mechanism for depositing very small ejected droplets in an accurate manner. When using acoustic ejection for color printing where more than one material is being ejected, it is beneficial to use a material deposition head with multiple ejector units. By material ejection head, it is meant a structure capable of ejecting a selected material from an associated chamber which is either the only chamber, or is one that is isolated from the other chambers. Therefore, a material deposition head with multiple ejector units is a structure capable of ejecting multiple materials. In terms of color printing, a material deposition head with multiple ejector units is a printhead capable of holding and ejecting more than one color of ink.

More detailed descriptions of acoustic droplet ejection and acoustic printing in general are found in the following U.S. patents and in their citations: U.S. Pat. No. 4,308,547 by Lovelady et al, entitled "LIQUID DROP EMITTER," issued Dec. 29, 1981; U.S. Pat. No. 4,697,195 by Quate et al., entitled "NOZZLELESS LIQUID DROPLET EJECTORS," issued Sept. 29, 1987; U.S. Pat. No. 4,719,476 by Elrod et al., entitled "SPATIALLY ADDRESSING CAPILLARLY WAVE DROPLET EJECTORS AND THE LIKE," issued Jan. 12, 1988; U.S. Pat. No. 4,719,480 by Elrod et al., entitled "SPATIALS STABILIZATION OF STANDING CAPILLARY SURFACE WAVES," issued Jan. 12, 1988; U.S. Pat. No. 4,748,461 by Elrod, entitled "CAPILLARY WAVE CONTROLLERS FOR NOZZLELESS DROPLET EJECTORS," issued May 31, 1988; U.S. Pat. No. 4,751,529 by Elrod et al., entitled "MICROLENSES FOR ACOUSTIC PRINTING," issued Jun. 14, 1988; U.S. Pat. No. 4,751,530 by Elrod et al., entitled "ACOUSTIC LENS ARRAYS FOR INK PRINTING," issued Jun. 14, 1988; U.S. Pat. No. 4,751,534 by Elrod et al., entitled "PLANARIZED PRINTHEADS FOR ACOUSTIC PRINTING," issued Jun. 14, 1988; U.S. Pat. No. 4,959,674 by Khri-Yakub et al., entitled "ACOUSTIC INK PRINTHEAD HAVING REFLECTION COATING FOR IMPROVED INK DROP EJECTION CONTROL," issued Sept. 25, 1990; U.S. Pat. No. 5,028,937 by Khuri-Yakub et al., entitled "PERFORATED MEMBRANES FOR LIQUID CONTROL IN ACOUSTIC INK PRINTING," issued Jul. 2, 1991; U.S. Pat. No. 5,041,849 by Quate et al., entitled "MULTI-DISCRETE-PHASE FRESNEL ACOUSTIC LENSES AND THEIR APPLICATION TO ACOUSTIC INK PRINTING," issued Aug. 20, 1991; U.S. Pat. No. 5,087,931 by Rawson, entitled "PRESSURE-EQUALIZED INK TRANSPORT SYSTEM FOR ACOUSTIC INK PRINTERS," issued Feb. 11, 1992; U.S. Pat. No. 5,111,220 by Hadimioglu et al., entitled "FABRICATION OF INTEGRATED ACOUSTIC INK PRINTHEAD WITH LIQUID LEVEL CONTROL AND DEVICE THEREOF," issued May 5, 1992; U.S. Pat. No. 5,121,141 by Hadimioglu et al, entitled "ACOUSTIC INK PRINTHEAD WITH INTEGRATED LIQUID LEVEL CONTROL LAYER," issued Jun. 9, 1992; U.S. Pat. No. 5,122,818 by Elrod et al., entitled "ACOUSTIC INK PRINTERS HAVING REDUCED FOCUSING SENSITIVITY," issued Jun. 16, 1992; U.S. Pat. No. 5,142,307 by Elrod et al., entitled "VARIABLE ORIFICE CAPILLARY WAVE PRINTER," issued Aug. 25, 1992; and U.S. Pat. No. 5,216,451 by Rawson et al., entitled "SURFACE RIPPLE WAVE DIFFUSION IN APERTURED FREE INK SURFACE LEVEL CONTROLLERS FOR ACOUSTIC INK PRINTERS," issued Jun. 1, 1993. All of these patents are hereby incorporated by reference.

The standard acoustic ink print head embodies a substrate having an acoustic wave generating means which is generally a planar transducer used for generating acoustic waves of one or more predetermined wave lengths. The wave generating means is positioned on the lower surface of the substrate. The transducer noted above is typically composed of a piezoelectric film such as zinc oxide positioned between a pair of metal electrodes, such as gold electrodes. Other suitable transducer compositions can be used provided that the unit is capable of generating plane waves in response to a modulated RF voltage applied across the electrodes. The transducer will be generally in mechanical communication with the substrate in order to allow efficient transmission of the generated acoustic waves into the substrate.

Generally an acoustic lens is formed in the upper surface of the substrate which is used for focusing acoustic waves incident on its substrate side to a point of focus on its opposite side. The acoustic lenses (whether spherical lenses or Fresnel lenses) are generally adjacent to a liquid ink pool which is acoustically coupled to the substrate and the acoustic lens. By positioning the focus point of such a lens at or very near a free surface of the liquid ink pool, droplets of ink can be ejected from the pool.

In the past to achieve varying color levels in acoustic ink printing, three approaches have been identified:

In the first approach, changing the length of the RF (and hence the acoustic burst) increases the droplet size by up to two times from its diffraction-limited minimum diameter of approximately one wave length. The second approach is to vary the number of droplets that are deposited per pixel. The third method involves increasing the number of shades of each color of ink used in the printer.

The present invention generally relates to a novel method and means for achieving variable color levels in ink printing, in particular acoustic ink printing, by using a lightening or darkening agent in combination with an underlying colored ink in a dot-on-dot type printing application.

SUMMARY OF THE INVENTION

The present invention describes a method of extending the color gamut of a colored printing ink through the use of a lightening or darkening agent. The present method is suitable for use in any known printing method such as ink jet printing, and, in particular, acoustic ink printing (AIP).

In accordance with the present invention, a printing apparatus is provided with multiple printheads. The printheads contain a plurality of ink ejectors arranged for dot-on-dot printing. At least one printhead is supplied with a color gamut extending agent or ink for depositing onto an initially deposited colored ink droplet. The color gamut extending agent or ink is selected from agents or ink compositions which lighten or darken the chroma of the underlying colored ink thereby extending the color gamut of the underlying colored printing ink.

An advantage attained from the method according to the present invention is that a minimum of one additional agent or ink is required to extend the color gamut of the principal colored inks which are typically supplied to a printer.

Another advantage realized from the method of the present invention is that only one additional printhead is needed to supply the color gamut extending agent or ink to the initial colored ink droplet as compared to the multiple additional printheads required when using inks of varying color shades.

DETAILED DESCRIPTION OF THE INVENTION

Figure 1:
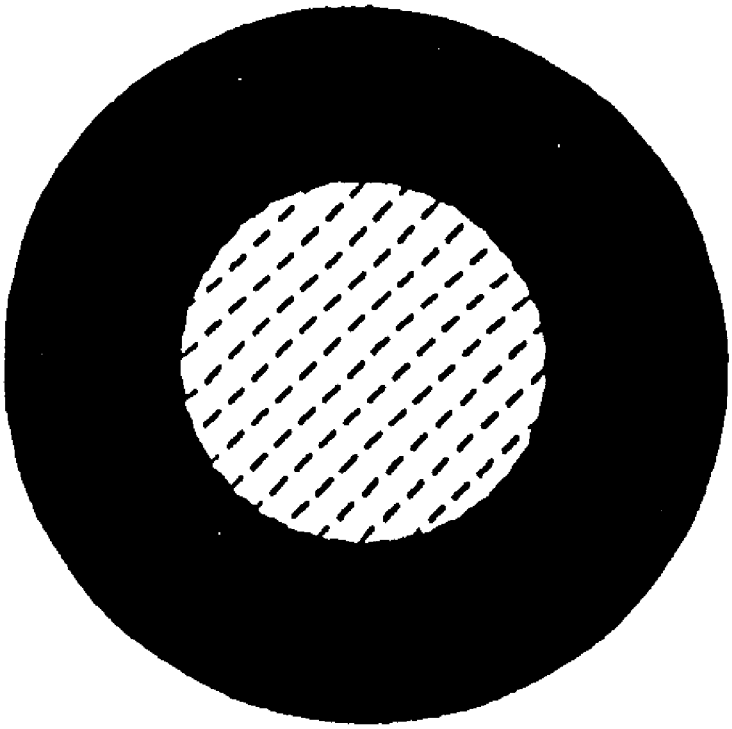
FIG. 1 shows an enlarged view of a single drop of an underlying colored ink having a light scattering ink deposited thereon.

In accordance with practicing the present invention, a printing device is provided which is capable of dot-on-dot printing. Such devices are taught in the prior art, for example, in U.S. Pat. Nos. 4,620,196 and 4,851,860. In particular, dot-on-dot printing devices which are well suited for practicing the present invention are acoustic ink type printers (AIP) which permit accurate placement of very small dots of ink onto a substrate. As will be readily recognized by the skilled artisan, with dot-on-dot type printing, accurate dot placement is essential to practicing the present invention.

The printer is provided with a selection of colored printing inks which will initially be deposited onto the substrate to be printed on. Typically the primary colors cyan, magenta, yellow and black are provided. However, colors such as red, green, grey, orange and other various colors may also be provided as colored inks.

The colored inks may be of any type typically used in a printing process. Hot-melt inks, liquid crystalline inks and various aqueous based inks, including aqueous/glycol based inks, are typically used in printing processes. However, the present invention is not intended to be limited to a particular underlying ink.

In a preferred embodiment, acoustic ink printers are provided with a colored ink capable of acoustic ink printing. Such inks are disclosed, for example, in U.S. Pat. Nos. 5,700,316;5,693,128;5,688,312;5,667,168; 5,643,357; and 5,281,261 the disclosures of which are incorporated herein by reference.

Examples of colorants, preferably dyes, selected for the inks of the present invention are known and include those as illustrated in U.S. Pat. No. 5,310,887, the disclosure of which is totally incorporated herein by reference, and include, for example, reference the Color Index, Resorcin Crystal Violet, Orasol Black RL or Intraplast Black RL/Solvent Black 29, Lapranol Black BR, Savinyl Black RLS, Black RLP, Orasol Black RLP, Neozapon Black X57; solvent yellow dyes inclusive of Savinyl Yellow 2 RLS, Savinyl Yellow RLSN, Intraplast Yellow 2GLN, Neozapon Yellow 081; Neozapon Yellow 141, Levaderm Lemon Yellow, Zapon Fast Yellow CGR, Aizen Fast Yellow CGNH, Zapon Yellow 100, Zapon Yellow 157, and Savinyl Yellow RLS; magenta dyes such as Neozapon Red 492, Direct Brilliant Pink B, Savinyl Pink 6 BLS, Savinyl Red 3 BLS, Orasol Red 2 BL, Intraplast Red G (Orasol Red), Savinyl Red BLSN, Savinyl Scarlet RLS, Savinyl Fire Red 3 GLS, and Zapon Red 335; cyan dyes Orasol Blue 2 GLN, Neozapon Blue 807, Savinyl Blue RLS, Savinyl Blue GLS, Orasol Blue GN, and RBX3 LV dye available from Milliken Chemicals, Losol Blue; brown dyes inclusive of Zapon Brown 187 and Savinyl Brown GLS, Solvent Green 3, Sudan Black B, Ceres Blue 2 V, Liquid Oil Jet Black, Macrolex Red G Gram, Macrolex Yellow 3 G, Victoria Blue R, available from Bayer AG, Leverkusen, Germany, Morfast Blue 100, Morfast Red 104, and Morfast Red 100, available from Morton International Specialty Chemicals Group, Chicago, Ill.; and mixtures thereof; and the like with preferred dyes in embodiments including Reactint Black 57 AB, Reactint Black X40 LV, Reactint Blue 17 AB, Reactint Blue X3 LV, Reactint Blue X19, Reactint Red X26 B-50, Reactint Red X520, Reactint Violet X80 LT, Reactint Orange X38, and Reactint Yellow X15, all available from Milliken Chemicals. Typically, the dye is present in the colored ink in an amount of from about 0 to about 10 percent by weight, preferably from about 0 to about 4 percent by weight, and more preferably from about 0 to about 3 percent by weight, although the amount can be outside these ranges.

Other optional ink additives include various conventional additives including humectants, surfactants, emulsifiers and/or biocides, such as Dowicil 150, 200, and 75, benzoate salts, sorbate salts, and the like, present in effective amounts such as, for example, an amount of from about 0.0001 to about 4 percent by weight, and preferably from about 0.01 to about 2.0 percent by weight. Additionally, pH controlling agents, such as acids or, bases, phosphate salts, carboxylates salts, sulfite salts, amine salts, and the like, present in an amount of, for example, from 0 to about 1 percent by weight and preferably from about 0.01 to about 1 percent by weight, or the like, can be included.

The color gamut extending inks of the present invention are selected from ink compositions which lighten or darken the chroma of the underlying initial colored ink thereby extending the color gamut of the initial colored ink.

Color gamut extending inks are typically liquid ink compositions which are selected from light scattering agents, blending agents or inks and opaque agents or inks.

The printing medium may be an opaque medium or a transparent medium.

In a first embodiment of the present invention, a light scattering agent is applied onto the surface of an initial colored ink dot which has been deposited onto the surface of the substrate to be printed on (FIG. 1). The light scattering ink will dry in a translucent state that causes light to be scattered. The degree of translucency will be controlled by the light scattering ink formulation. The area coverage and thickness of the modifying ink will control the degree of lightening or darkening. In the case of printing on paper, incident light will be reflected from either small particles or gaps in the modifying ink. When this ink is printed over a spot of colored ink on paper, the light reflected will lighten the apparent color of the spot. In the case of printing on transparency film, transmitted light will be reflected back from the particles or fractures in the light scattering ink and make the apparent color more opaque and thus more dark.

Various types of light scattering agents may be used in accordance with the present invention including, but not limited to, aqueous/glycol ink compositions, phase change waxes, gelatins, and other translucent inks and toners. Specific examples include, but are not limited to, latexes and fumed silica.

Figure 2:
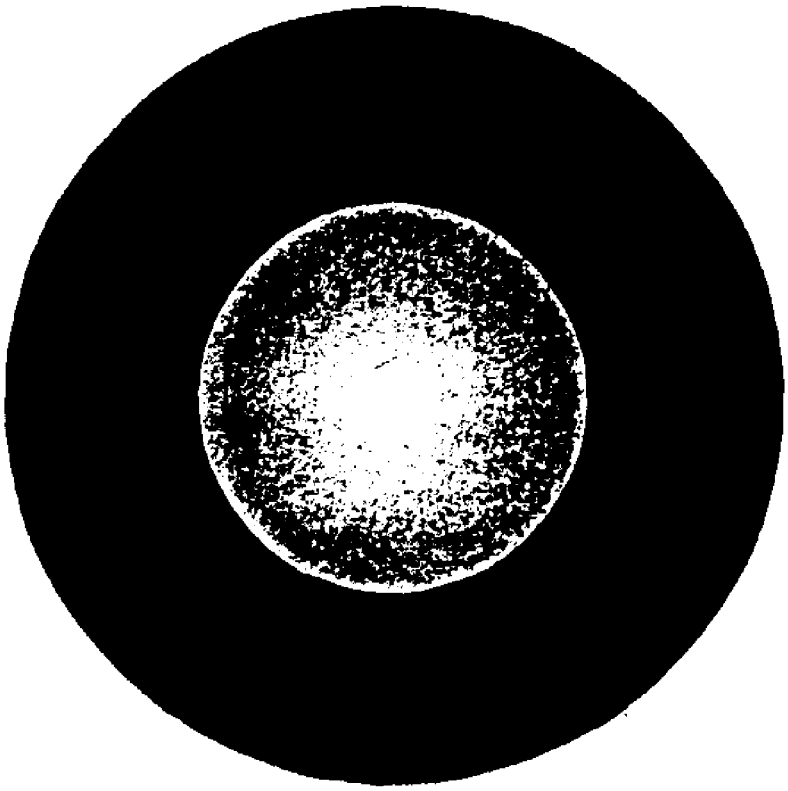
FIG. 2 shows an enlarged view of a single drop of an underlying colored ink having a blending agent deposited thereon.

In a second embodiment of the present invention, a blending agent or ink is applied onto the surface of an initial colored ink which has been deposited onto the surface of the substrate to be printed on (FIG. 2). In a particular embodiment, the blending agent or ink will be a clear, white, or translucent (no dye or color/black pigment) version of the particular type of ink being used in the printer. The intention here is to dilute the ink dynamically rather than devote separate print devices for each dilute ink composition. For instance, instead of printing with black, gray, cyan, light cyan, magenta, light magenta, and yellow as in some ink jet printers, the novel approach would be to print with black, cyan, magenta, yellow, and the modifying ink. This would allow mixing different dilutions on the paper at the spot location while the inks are still wet. (For example, 1 drop of color and 10 drops of modifying ink would spread the dye of one drop of color into the area covered by the 11-drop blend volume).

Figure 3:
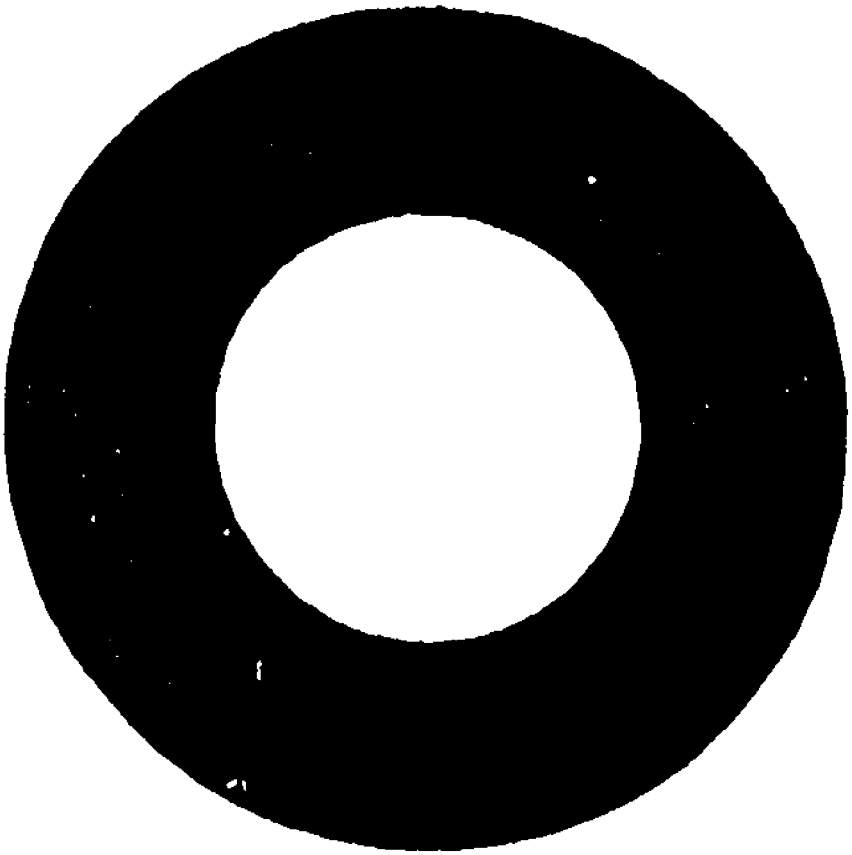
FIG. 3 shows an enlarged view of a single drop of an underlying colored ink having an opaque agent deposited thereon.

In a third embodiment of the present invention, an opaque agent or ink is applied onto the surface of an initial colored ink which has been deposited onto the surface of the substrate to be printed on (FIG. 3). The opaque agent may be an opaque version of the particular type of ink being used in the printer. The method is similar to the light scattering ink approach mentioned hereinbefore, except that the particle loading is such that all light is reflected (when printing on paper) or blocked (when printing on transparencies) rather than scattered as described above.

The amounts of color gamut extending agents or inks used in accordance with the present invention can vary from about 0% to greater than 100% depending upon the degree of lightening or darkening required.

In practicing the present invention, a printer, capable of dot-on-dot printing, is supplied with colored printing inks (typically cyan, magenta, yellow and black) and at least one type of color gamut extending ink as set forth hereinbefore. The initial colored printing ink is deposited onto the surface of the substrate to be printed on. The initial deposition is then followed by the deposition of a color gamut extending ink onto the surface of the initial colored printing ink thereby imparting a color gamut extending effect to the underlying colored ink. By way of example, an acoustic ink printer is supplied with at least one printhead containing a colored ink composition and at least one printhead containing an uncolored ink of the same type of ink used in the colored ink composition (i.e. a blending ink). One drop of the underlying colored ink is discharged onto a substrate when that particular base color is called for. Subsequently, one or more drops of the uncolored ink is/are deposited onto the colored base ink thereby diluting and spreading the base ink to form an area of the desired color.

In this way, the color gamut of the initial colored inks can be extended with minimal cost and minimal additional equipment by supplying a minimum of one additional color gamut extending agent or ink and an additional printhead and/or ink ejector to the printer.

The foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalence may be resorted to falling within the scope of the invention.

What is claimed is:

1. A method for extending the color gamut of a printing ink comprising:

a) depositing an initial colored printing ink droplet onto a surface to be printed; and b) subsequently depositing a light scattering compound onto the initial ink droplet;

wherein the light scattering compound extends the chroma of the underlying initial ink thereby extending the color gamut of the printing ink.

2. The method of claim 1 wherein the light scattering compound is selected from the group consisting of latexes, fumed silica, waxes and gelatins.

3. The method according to claim 1 wherein the depositing is performed by an acoustic ink printing (AIP) apparatus.

4. The method according to claim 1 wherein the color gamut extending agent or ink is deposited in an amount to cover from about 0% of the area of the initial colored printing ink droplet to greater than 100% of the area of the initial colored printing ink droplet.

5. The method of claim 1 wherein the light scattering compound droplet is a lightening agent or ink which lightens the chroma of the underlying initial ink.

6. The method of claim 1 wherein the light scattering compound droplet further comprises conventional ink adjuvants.

7. A printing process for extending the color gamut of an ink composition by lightening or darkening the chroma of the ink composition, said process comprising incorporating into an acoustic ink jet printer a first ink composition comprising a colorant and a carrier vehicle; and, a second ink composition comprising a color gamut extending agent or ink selected from i) a light scattering agent ii) a blending agent or ink, or iii) an opaque agent or ink wherein said printing process comprises, causing said first ink composition to form a droplet by radiating onto a pool of the first ink, focused acoustic radiation, wherein said droplet of first ink is projected onto a printable surface, further wherein said printing process causes said second ink composition to form a droplet by radiating onto a pool of the second ink composition, focused acoustic radiation, wherein said droplet of said second ink composition is projected onto the droplet of said first ink, thereby extending the color gamut of the first ink.

8. The printing process of claim 7 wherein the first ink composition is a phase change ink.

9. The printing process of claim 7 wherein the first ink composition is an aqueous ink.

10. The printing process of claim 7 wherein the color gamut extending agent or ink is a lightening agent or ink which lightens the chroma of the first ink.

11. The printing process of claim 7 wherein the color gamut extending agent or ink is an agent or ink which darkens the chroma of the first ink.

12. The printing process of claim 7 wherein the droplet of said color gamut extending agent or ink is deposited onto the first ink droplet in an amount to cover greater than about 0% and up to greater than 100% of the area of the first ink droplet.

13. The printing process of claim 7 wherein the colorant in said first ink is dye present in an amount of from about 0 to 3 weight percent.

14. The printing process of claim 7 wherein the colorant in said first ink is the dye cyan, magenta, yellow, blue, green, red, brown, black, or mixtures thereof.

15. A lightening agent or ink composition for use in an acoustic ink printing apparatus said lightening agent or ink composition comprising a compound selected from light scattering agents, blending agents or inks and opaque agents or inks.

16. The composition of claim 15 wherein the lightening agent or ink is a light scattering agent selected from latexes, fumed silica, waxes and gelatins which are suitable for acoustic ink printing.

17. The composition of claim 15 wherein the lightening agent or ink is a blending agent or ink selected from a clear, white or translucent ink suitable for acoustic ink printing.

18. The composition of claim 15 wherein the lightening agent or ink is a white, opaque agent or ink suitable for use in acoustic ink printing.

19. The composition of claim 15 wherein the lightening agent or ink composition further comprises conventional acoustic ink additives.

* * * * *